US008070659B2

(12) United States Patent
Gagnon et al.

(10) Patent No.: US 8,070,659 B2
(45) Date of Patent: Dec. 6, 2011

(54) ORTHOPEDIC EXERCISER

(75) Inventors: Guy Gagnon, St-Albert (CA); André Foucault, Victoriaville (CA); Patrick Marcoux, St-Pierre-Baptiste (CA)

(73) Assignee: Robovic, NC., Quebec (CA)

( * ) Notice: Subject to any disclaimer, the term of this patent is extended or adjusted under 35 U.S.C. 154(b) by 1126 days.

(21) Appl. No.: 10/557,323

(22) PCT Filed: May 21, 2004

(86) PCT No.: PCT/CA2004/000760

§ 371 (c)(1),
(2), (4) Date: Oct. 10, 2006

(87) PCT Pub. No.: WO2004/103483

PCT Pub. Date: Dec. 2, 2004

(65) Prior Publication Data

US 2007/0037666 A1 Feb. 15, 2007

(30) Foreign Application Priority Data

May 21, 2003 (CA) ..... 2429219

(51) Int. Cl.
*A63B 21/00* (2006.01)
*A63B 21/012* (2006.01)
*A61H 1/00* (2006.01)

(52) U.S. Cl. ..... 482/137; 482/133; 482/114; 601/23; 601/34

(58) Field of Classification Search ..... 482/56, 482/97, 98, 100, 133–138, 114, 118, 119, 482/60, 904; 601/23, 33–35
See application file for complete search history.

(56) References Cited

U.S. PATENT DOCUMENTS

| | | | | |
|---|---|---|---|---|
| 2,664,886 | A * | 1/1954 | Coffman | 602/15 |
| 3,013,799 | A * | 12/1961 | Wise | 482/118 |
| 3,768,808 | A * | 10/1973 | Passera | 482/114 |
| 4,247,098 | A | 1/1981 | Brentham | |
| 4,323,060 | A * | 4/1982 | Pecheux | 602/33 |
| 4,441,708 | A * | 4/1984 | Brentham | 482/112 |
| 4,509,745 | A * | 4/1985 | Angsten | 482/98 |
| 4,749,182 | A * | 6/1988 | Duggan | 482/114 |
| 4,850,585 | A * | 7/1989 | Dalebout | 482/51 |
| 4,867,439 | A * | 9/1989 | Salyer | 482/68 |
| 4,986,261 | A * | 1/1991 | Iams et al. | 601/35 |
| 4,986,537 | A * | 1/1991 | D'Orta | 482/119 |
| 5,108,092 | A * | 4/1992 | Hurst | 482/60 |

(Continued)

FOREIGN PATENT DOCUMENTS

DE 465736 C 9/1928

(Continued)

*Primary Examiner* — Allana Lewin
(74) *Attorney, Agent, or Firm* — Muirhead and Saturnelli, LLC

(57) ABSTRACT

The present invention generally relates to an orthopedic exerciser and its actuating mechanism which, more specifically, are used for therapy, post-surgery rehabilitation or healing of a knee, of a joint, or the muscles of a leg or any other body member. Such exercisers usually allow a combination of exercises that help in the recovery of the joint, but to minimize the chances of further injuring the body part and therefore increase the recovery process, the exerciser must submit the body part to a controlled level of force. The orthopedic exerciser of the present invention includes an actuating mechanism cooperating with a resistance assembly which provides resistance and/or assistance along different directions of movement of the actuating mechanism.

22 Claims, 9 Drawing Sheets

U.S. PATENT DOCUMENTS

| | | | | |
|---|---|---|---|---|
| 5,244,446 | A * | 9/1993 | Engel et al. | 482/137 |
| 5,338,274 | A * | 8/1994 | Jones | 482/100 |
| 5,833,575 | A * | 11/1998 | Holslag | 482/51 |
| 6,224,521 | B1 | 5/2001 | Foucault et al. | |
| 6,773,378 | B2 * | 8/2004 | Bastyr et al. | 482/115 |
| 6,962,554 | B2 * | 11/2005 | Keiser | 482/112 |
| 7,070,545 | B2 * | 7/2006 | Lull et al. | 482/100 |
| 2002/0193710 | A1 * | 12/2002 | Main et al. | 601/5 |
| 2003/0216229 | A1 * | 11/2003 | Bastyr | 482/115 |
| 2004/0204294 | A2 * | 10/2004 | Wilkinson et al. | 482/54 |
| 2006/0100066 | A1 * | 5/2006 | Maresh et al. | 482/52 |

FOREIGN PATENT DOCUMENTS

| | | |
|---|---|---|
| DE | 515747 C | 1/1931 |

* cited by examiner

ORTHOPEDIC EXERCISER

FIELD OF THE INVENTION

The present invention generally relates to orthopedic exercisers. More specifically, the present invention is concerned with exercisers and its actuating mechanism for therapy, post-surgery rehabilitation or healing of a knee or the muscles of body members.

BACKGROUND OF THE INVENTION

Various surgical techniques have been known since the early 80's for the treatment of articular disorders. The complete replacement of an articulation of the knee is commonly practiced nowadays. Rehabilitation of operated knees has become needy and different new options have been developed.

Several exercises have been proposed in different rehabilitation programs. They all aim to recover the knee to the normal articular mobility to disappearance of pain, to functional proprioception and to normal muscular function.

Currently there are four main types of exercises to aid in the rehabilitation of the knee, namely, passive, active assisted, active and "against resistance". The condition of the patient may determine the type of exercise to be practiced.

Traditionally, passive movements were used to allow a gain of amplitude in the articular movement by diminishing inflammatory reactions, pain or muscular cramps. The exercises requiring active muscular movement usually follow after disappearance of the pain.

A CPM (Continuous Passive Motion) apparatus is a commonly used apparatus in knee rehabilitation. This apparatus allows execution of passive flexion and extension movement during a long period of time and without effort from the patient. CPM may be very efficient in terms of reducing pain in the knee or leg in post-surgery rehabilitation treatment, reducing hospitalization time and reducing a number of complications that may occur during the rehabilitation period. However, CPM does not replace functional activity and active movement.

Once the patient is able to execute contraction of muscles without excessive pain, which may be very soon, active assisted movement of the leg is practiced. It is then possible to gain range of movement (ROM) without any motorized assistance. Generally, simple mechanical assistance in either flexion or extension movement allows greater benefits than a motorized device. Assistive active devices are necessary when muscles are not functional enough to move the joint in the devised range.

The next step to undertake for allowing full recovery of the knee or leg is to execute "against resistance" exercises. Actually, this type of exercise allows restoration of proprioceptive neuromuscular facilitation. It is known that rehabilitation of a muscle and maintenance of development of the muscle tone is possible from the different reflex mechanisms generated by stretching of the muscle which results from the physical action of the muscle itself.

Different publications and patents disclose various apparatuses allowing application of resistance during extension of the knee through a movement of an arc of a circle. The thigh is maintained still or partially still, whether the patient is sitting or lying down. Other apparatuses comprise a simple support for receiving a thigh and a resistance device which may be a bag of sand attached to the foot. In other instances, the resistance device may be an elastic band. In all cases, the foot usually lacks proper support and the resistance is exercised on the wrong portion of the leg, for instance, in the lower portion, i.e. the shank. All these apparatus challenge the muscles in a wrong bio-mechanical way, and may damage the knee. These old-fashioned exercises are so called "open circuit" type.

Obviously, it is important to provide an apparatus that will allow execution of the exercise without causing tension on the knee. Recent data have shown the best benefits of a new approach.

Also known in the art is U.S. Pat. No. 6,224,521, issued to Foucault, which describes a solution to the above-mentioned problems. However, the apparatus described therein has some disadvantages, notably its lack of ergonomics.

OBJECTS OF THE INVENTION

An object of the present invention is therefore to provide an apparatus which allows the performance of a wide range of exercises for a leg or other body members, without causing excessive tension on the knee or joint.

SUMMARY OF THE INVENTION

More specifically, in accordance with the present invention, there is provided an orthopedic exerciser for a body member of a user including a support frame including a generally elongated frame portion and a support portion extending away from the frame portion; an actuating mechanism including a shaft and an actuating assembly; the shaft being mounted to the support portion and defining a pivot axis; the actuating assembly including a member having a first end so mounted to and extending away from the shaft as to pivot about the pivot axis and a second end so configured as to receive an actuating force; and a resistance assembly linking the support portion and the actuating mechanism; such that upon operation of the orthopedic exerciser, the actuating assembly pivots along two directions of movement, one of the direction of movement being resisted to by the resistance assembly.

There is furthermore provided an actuating mechanism for an exerciser including a support portion which is generally structurally immobile; a shaft which is mounted to the support portion and defines a pivot axis; an actuating assembly including a member having a first end so mounted to and extending away from the shaft as to pivot about the pivot axis and a second end so configured as to receive an actuating force; and a resistance assembly linking the support portion and the actuating assembly; such that upon operation of the actuating assembly, the member pivots along two directions of movement, one of the directions of movement being resisted to by the resistance assembly.

Other objects, advantages and features of the present invention will become more apparent upon reading of the following non-restrictive description of preferred embodiments thereof, given by way of example only with reference to the accompanying drawings.

DETAILED DESCRIPTION

Generally stated, the present invention relates to an orthopedic exerciser and its actuating mechanism which may be used for therapy, post-surgery rehabilitation, exercising or healing of a knee, a joint, the muscles of a leg, or any other body members. The exerciser of the present invention allows a complete combination of exercises that help in the recovery of the joint, performed in a normal functional way, by applying resistance or assistance on the plantar part of the foot and sometimes, to the upper portion of the body member. These exercises are called "closed circuit exercises", or "closed kinetic chain" exercises. They challenge muscles and articulation in the proper bio-mechanical way.

Figure 1:
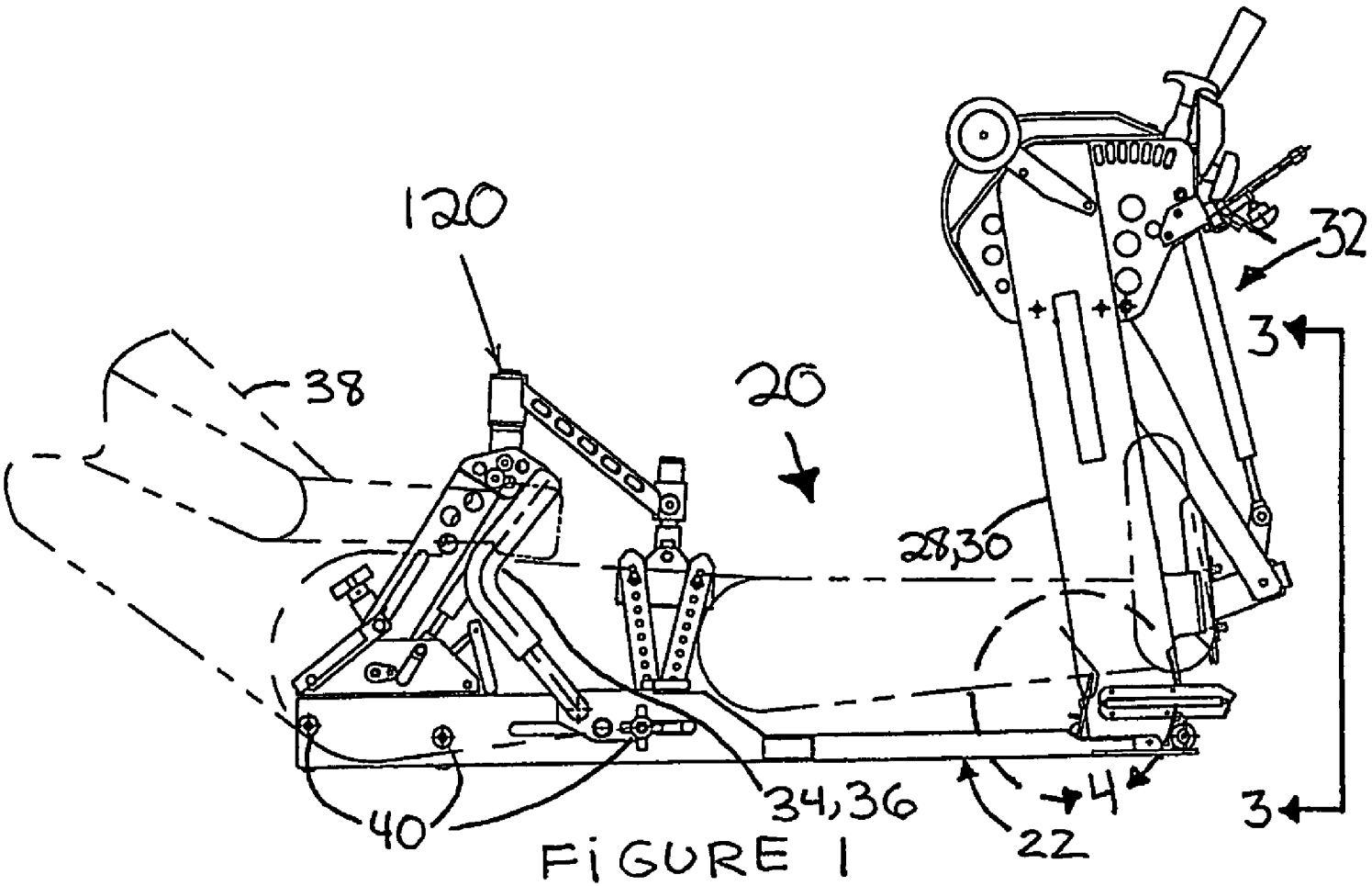
FIG. 1, is a side elevation view of an apparatus according to an embodiment of the present invention.
Figure 2:
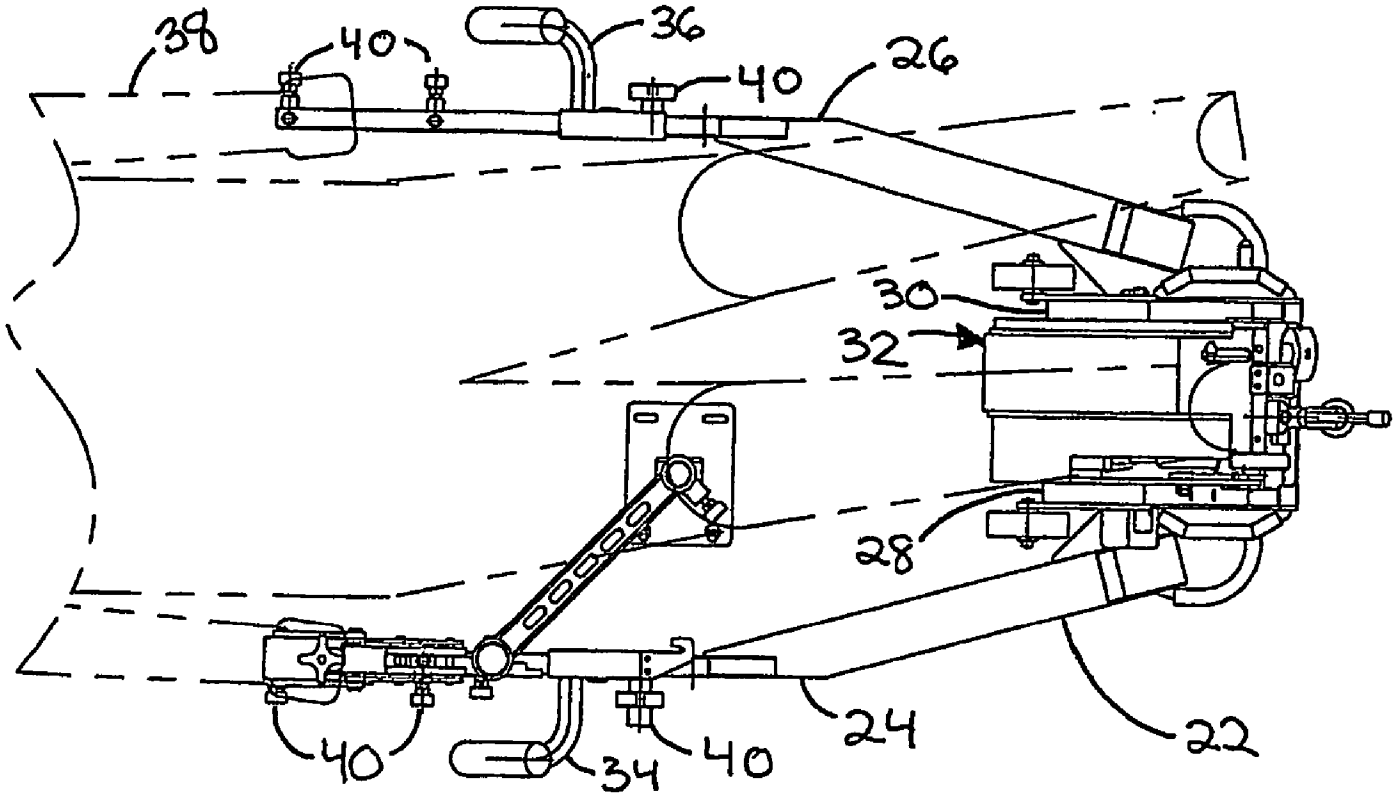
FIG. 2, is a top view of the apparatus of FIG. 1.
Figure 3:
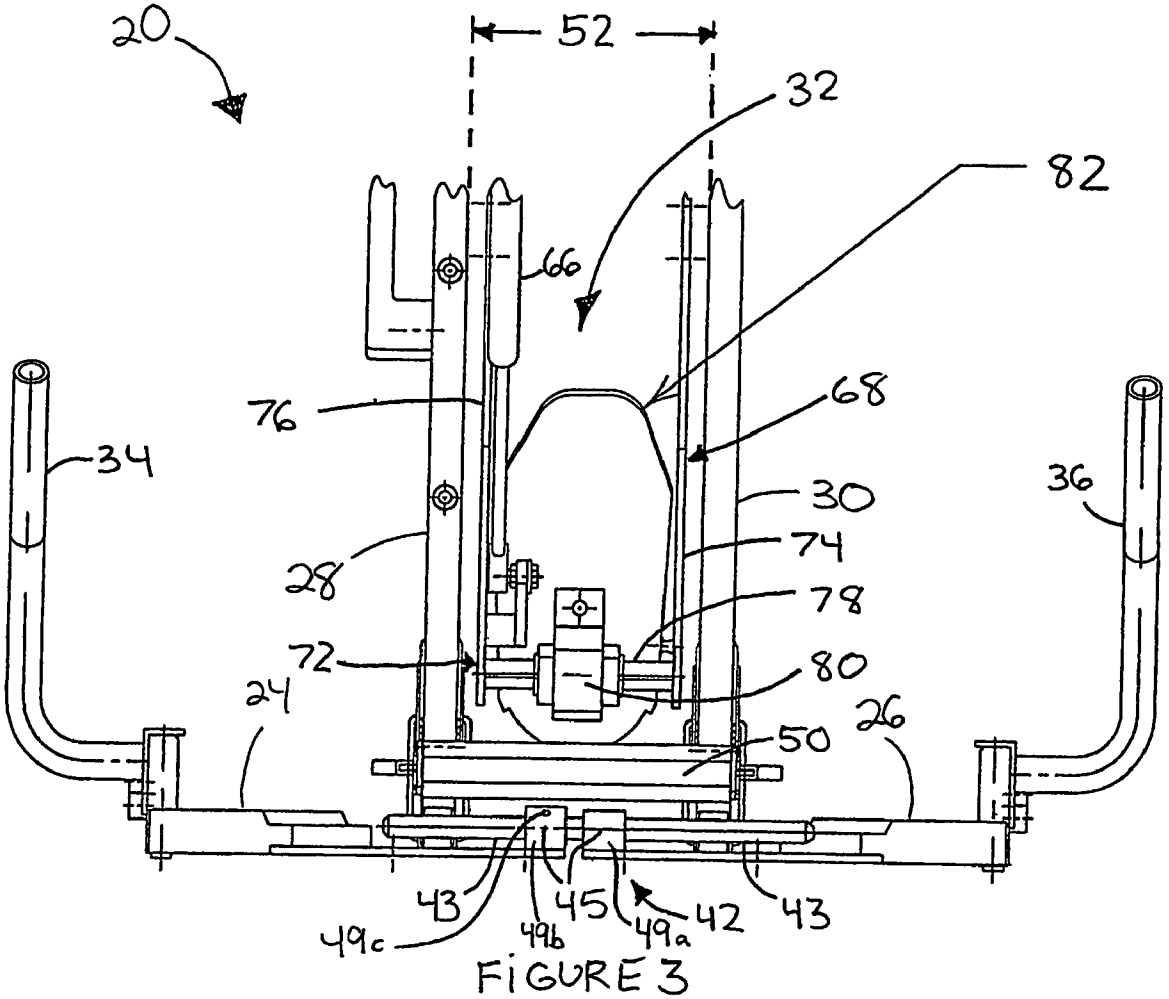
FIG. 3 is an end view taken along line 3-3 in FIG. 1.

As illustrated in FIGS. 1 to 3, the orthopedic exerciser 20 generally includes a support frame 22 which is provided with two elongated bars 24, 26. The support frame 22 provides mounting provisions to a fixed structure such as beams 28, 30 which generally extend from the support frame 22 to provide support for an actuating mechanism 32.

The support frame 22 is so configured as to be positioned on a generally flat surface or in a position which provides overall rigidity and stability to the exerciser 20. As seen in FIGS. 1 to 3, the bars 24, 26 are separated, and are linked in a generally V-shaped configuration near where the beams 28, 30 are mounted. Each bars 24, 26 is provided with adjustable handles 34, 36 that a user 38 can grasp while using the exerciser 20 and include attachment means 40 such as for example nuts and bolts, screws, clips to removably mount the handles 34, 36 and other components to the exerciser 20.

Each beams 28, 30 is fixedly positioned with respect to the support frame 22 and is removable. The beam 28, 30 are laterally positioned with respect to the support frame 22 or in between the bars 24, 26 such that the beams 28, 30 are positioned symmetrically with respect to the bars 24, 26 or more toward one of the bars 24, 26 to suit the needs of the user of the apparatus 20.

Figure 4:
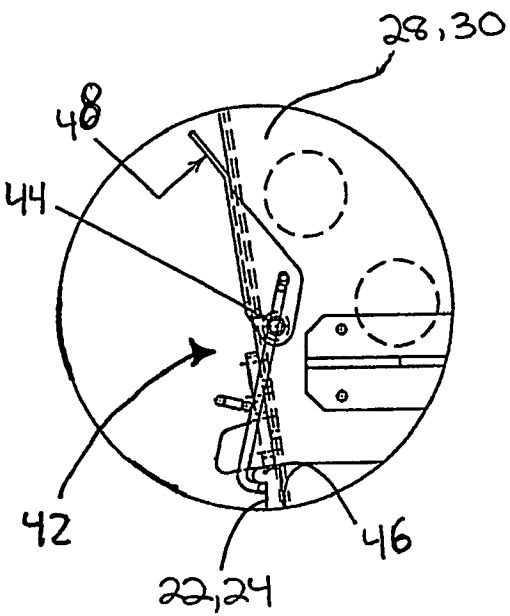
FIG. 4 is a detail view showing a clipping attachment used in the apparatus of FIG. 1.

As illustrated in FIG. 3, the beams 28, 30 are removably mounted on the bars 24, 26 through connectors 42 to allow easy assembly and disassembly of the beams 28, 30 from the exerciser 20. The connectors 42 includes, for example, nuts and bolts, screws, clips 44 (FIG. 4) being pivotally mounted on the beams 28, 30 or a slidable pin 43 and slot 45 arrangement (FIG. 3). The clip 44 shown in FIG. 4 is secured to and unsecured from a protrusion 46 on the bars 24, 26 via a toggle member 48.

The slidable pin 43 and slot 45 arrangement of FIG. 3 is also configured such that the pin 43 slidably extend from one boss 49*a* of the bars 24, 26 and that the other boss 49*b* includes the slot 45 slidably receiving the pin 43. A lock 49*c* is included on the boss 49*b* to fix the pin 43 on the bar 24. This arrangement provides adjustability in a lateral direction for the relative positioning of the two bars 24, 26 which enables the apparatus 20 to fit various sizes of users. The bars 24, 26 are secured when the beams 28, 30 are installed, as described hereinabove.

In FIG. 3, the beams 28, 30 are also fixedly attached to a base 50. In this case, it is through the base 50 that the beams 28, 30 are removably mounted to the support frame 22. The beams 28, 30 generally extend upwardly from the support frame 22, at a distance from each other defining an opening 52 therebetween.

The opening 52 provides the required space to localize the actuating mechanism 32. The mechanism 32 is illustrated in more details in FIGS. 5 to 11 and includes a generally fixed portion 54 and a generally mobile portion 56.

The fixed portion 54 generally include a housing 58 removably mounted to the beams 28, 30 defining a closed or partially closed inner chamber 60. If no housing 58 is provided in the mechanism 32, the structural function of the housing 58 is achieved through fixed connections to the top of each beam 28, 30, or to any other fixed location on the exerciser 20, providing that the actuating mechanism 32 does not interfere with the rest of the exerciser 20.

The mobile portion 56 includes a shaft 62 and an actuating assembly 64 which is connected to an actuator 66. The shaft 62 is rotatably mounted to the fixed portion 54, such as for example through bosses 67 fixedly mounted on the housing 58. The actuating assembly 64 includes a member 68 extending from the shaft 62. The member 68 has a first extremity 70 fixedly mounted to the shaft 62 and a second extremity 72 so configured as to receive an actuating force.

Alternatively, the shaft 62 could be made part of the fixed portion 54. In this case however, some components mounted on the shaft 62, such as for example the member 68 should be rotatably mounted on the shaft 62, through bearings for example.

Figure 5:
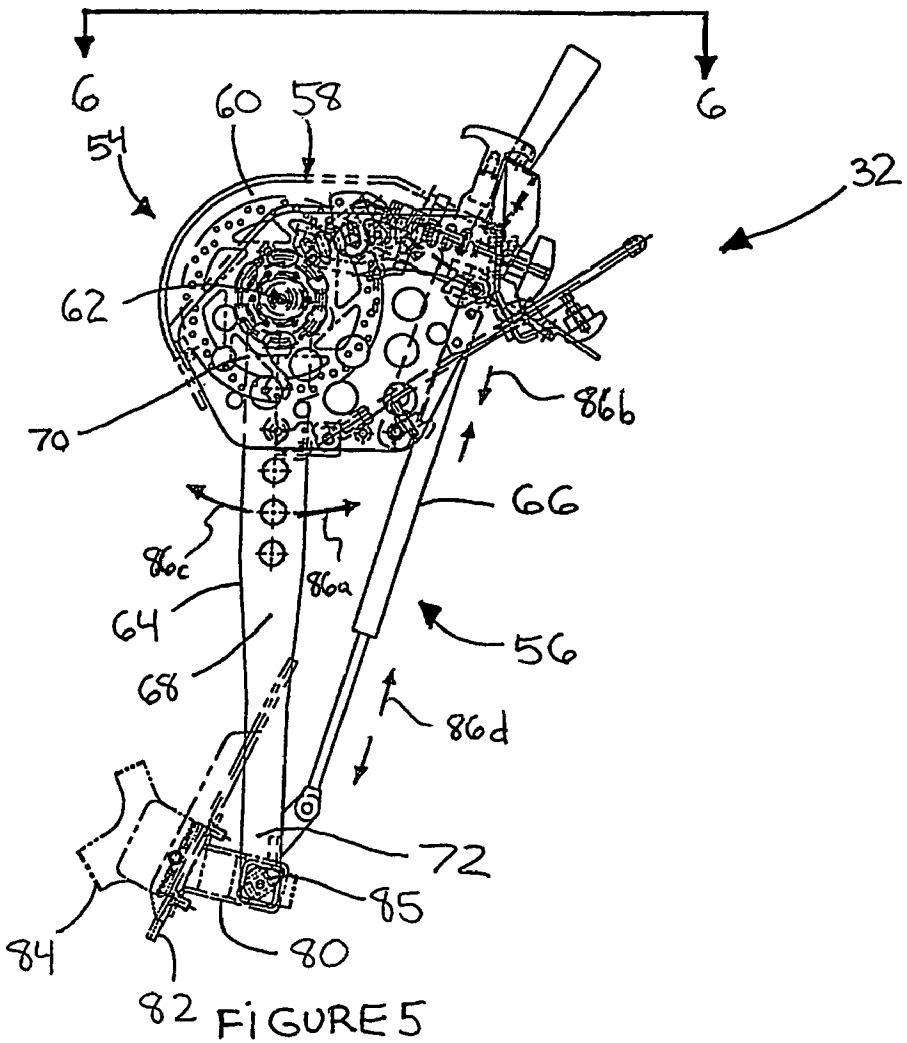
FIG. 5 is a detail view showing an actuating mechanism of the apparatus of FIG. 1.

As shown in FIGS. 3 and 5, the member 68 is made of two legs 74, 76 rigidly attached to a base 78 from which a radial arm 80 supports a rest portion 82. The rest portion 82 is configured as to receive an actuating force such as for example a flexion or an extension force coming from a foot. The rest portion 82 is a plate or is designed to fit underfoot surfaces and includes an attachment 84, such as for example a strap or a net for stabilizing a foot.

The rest portion 82 and the radial arm 80 are pivotally mounted to the member 68 via a rotational damper 85 inserted in a gap between the base 78 and the radial arm 80. The damper 85 is made from rubber and has a generally square or rectangular cross-section allowing a partial relative movement between radial arm 80 and the member 68. The damper 85 therefore provides a plantar support which helps resist against plantar flexion of the foot during actuation.

The actuating mechanism 32 includes a variety of resistance means which influence the necessary force level to actuate the actuating assembly 64. The actuator 66 represents one possible resistance means when positioned accordingly.

Figure 7:
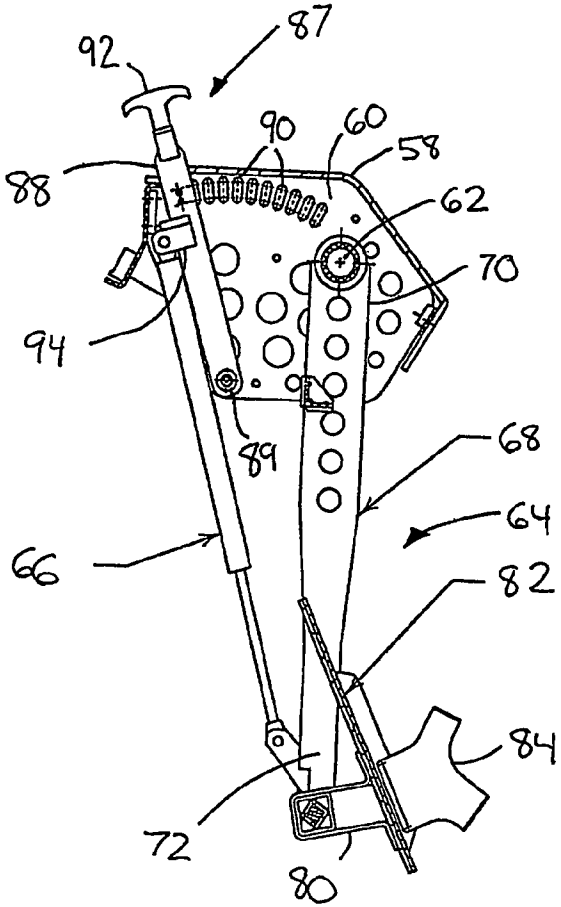
FIG. 7 is a sectional view taken along line 7-7 in FIG. 6.
Figure 6:
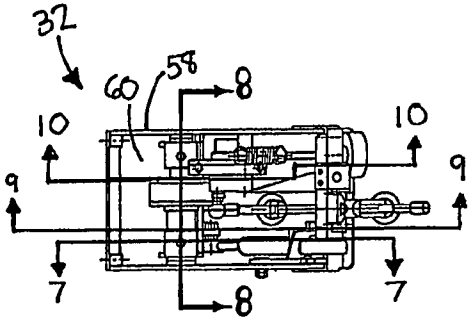
FIG. 6 is a top view taken along line 6-6 in FIG. 5.

As seen in FIGS. 5 and 7, the actuator 66 is generally pivotally mounted on one end near the second extremity 72 of the member 68 and generally pivotally mounted to the fixed portion 54 of the mechanism 32. In the Figures, the actuator 66 is embodied by a gas cylinder which provides resistance against motion of the actuating assembly 64 in one direction 86*a*, such as for example when the cylinder compresses 86*b*, and provides assistance in the other direction 86*c* of movement of the actuating assembly 64, such as for example when the cylinder extends 86*d*.

As can be better seen from FIG. 7, the actuator 66 is further provided with a force-position selector 87. The selector 87 includes an arm 88 which is pivotally mounted to the housing 58 via a pivot mount 89 on one end and selectively movable on the other end, by pivoting the arm 88 about the pivot mount 89. The positions of the arm 88 are restrained by a pin (not shown) extending from the arm 88 which engages one of a plurality of notches 90 in the housing 58. The position selector 87 further includes a handle 92.

The selector 87 includes a connector 94, to which one end of the actuator 66 is pivotally mounted. By pivoting the selector 87, the connector 94 carries the actuator 66 to a different relative position with respect to the actuating assembly 64, which has the effect of varying the resistance at the actuating assembly 64.

It is to be noted that the selector 87 is so configured as to work with the other end of the actuator 66, and that various types of actuators 66 are available to accomplish the same function, such as for example spring loaded mechanisms or other types of mechanism which includes resistance in one direction of motion of the actuating assembly 64 and includes an assistance force in the other direction.

As illustrated in FIGS. 8, 9, 10 and 11 a friction assembly 96 is another resistance means of the mechanism 32 which influences the resistance or the necessary force level to actuate the actuating assembly 64. The friction assembly 96 generally offers resistance against motion of the actuating assembly 64.

The friction assembly 96 includes a disc 98 and calipers 100, which function as a typical or standard disc brake. In the shown embodiment, the calipers 100 are fixed, and the disc 98 is movable.

More specifically, the calipers 100 are fixedly positioned to the fixed portion 54 of the mechanism 32, on each side of the disc 98. The tension provided by the friction assembly 96 is adjusted by varying the tension or normal force of the calipers 100 which is exerted on the disc 98.

The friction assembly 96 includes a cursor 102 linked to a spring 104 which is connected to the calipers 100 via a lever 103 and to the fixed portion 54 via a saddle 105. By operating the cursor 102, the spring 104 and lever 103 varies the normal force of the calipers 100 applied to the disc 98.

Figure 8:
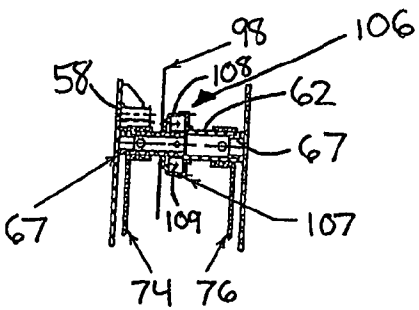
FIG. 8 is a sectional view taken along line 8-8 in FIG. 6.

The disc 98 is generally mounted to the shaft 62 through a one-way clutch 106, such that the resistance of the friction assembly 96 is present in only one direction of movement of the actuating assembly 64. As illustrated in FIG. 8, the clutch 106 is generally a cam type clutch which includes an inner race 107 fixedly mounted to the shaft 62, an outer race 108 fixedly mounted to the disc 98 and a one-way rolling system 109.

This configuration allows the one-way rolling system 109 to carry the outer race 108 and therefore, its fixedly positioned disc 98, in one movement direction of the actuating assembly 64. In this case the moving disc 98 interacts with the calipers 100 and offer resistance to the movement of the actuating assembly 64.

In the other direction, the one-way rolling system 109 does not roll with respect to the outer race 108 or does not carry the outer race 108. In this case the disc 98, which is fixedly positioned to the outer race 109, is not carried and therefore does not interact with the calipers 100 to offer resistance to the movement of the actuating assembly 64.

Therefore, the resistance generated by the friction assembly 96 is present in only one direction of movement of the actuating assembly 64. In the other direction of movement, the movement of the actuating assembly 64 is generally not influenced by the friction assembly 96 and is further assisted if the actuator 66 is used accordingly, as described hereinabove.

Figure 10:
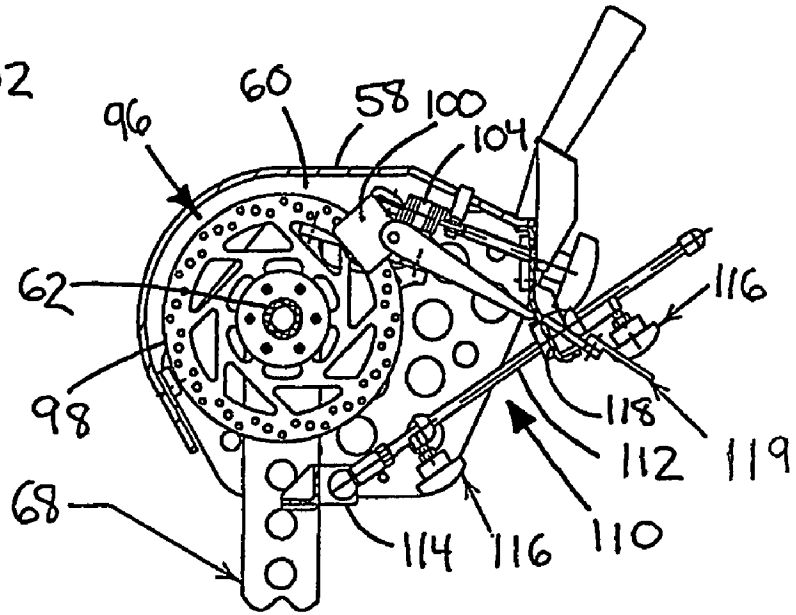
FIG. 10 is a sectional view taken along line 10-10 in FIG. 6.
Figure 9:
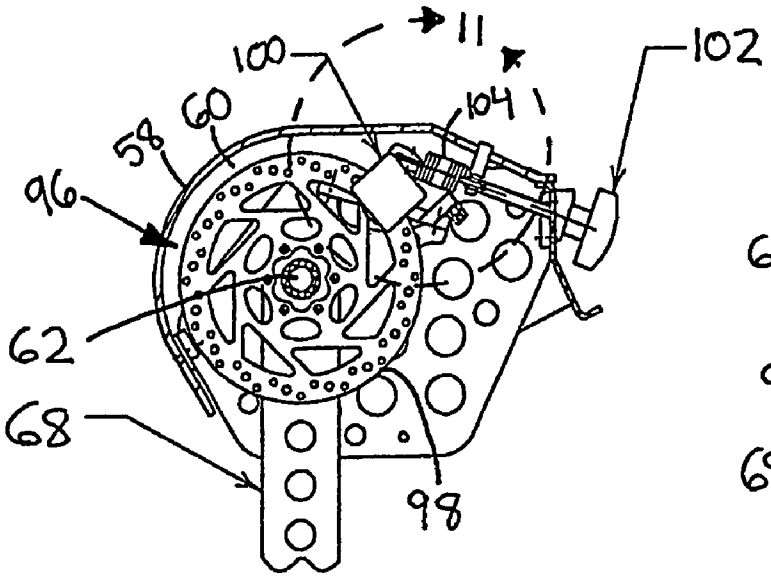
FIG. 9 is a sectional view taken along line 9-9 in FIG. 6.
Figure 11:
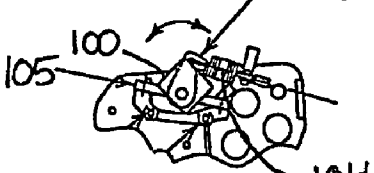
FIG. 11 is a partial detail view taken from enclosure 11 in FIG. 9.

The mechanism 32 is also be provided with a stroke limiting means 110 for limiting the range of motion of the actuating assembly 64, as illustrated in FIG. 10. The stroke limiting means 110 includes an elongated member 112 such as for example a rod which is generally rotatably mounted on one end to the member 68 via a bracket 114 on the member 68, and slidably supported on another end to the housing 58 or to the fixed portion 54.

At least one cursor 116 is movably mounted to the elongated member 112 to span over its length. As seen in FIG. 10, two cursors 116 is located on each side of a barrier 118 on the housing 58, which will have the effect of delimiting the amplitude of motion of the actuating assembly 64.

A stopper 119 is further provided to securely block the movement of the actuating assembly 64 by cooperating with the rod 112 of the stroke limiting means 110 and the barrier 118. The stopper 119 is a plate including a slot (not shown) which is so configured as to allow the movement of the rod 112 and which also has a form generally similar to the cross section of the rod 112.

The stopper 119 is rotatably positioned with respect to the rod 112 such that it lies generally flat with the barrier 118 or such that it is angled with respect to the barrier 118, as in the configuration shown in FIG. 10.

When positioned generally flat on the barrier 118, the slot (not shown) of the stopper 119 and the rod 112 are generally aligned such that the rod 112 and therefore the actuating assembly 64 are free to move.

When angled on the barrier 118, the slot (not shown) of the stopper 119 and the rod 112 interfere because they are not generally aligned. This configuration has the effect of blocking the movement of the rod 112 because the stopper 119 stays angled on the barrier 118. In one direction of movement, the rod 112 and therefore the actuating assembly 64 are not free to move. In the other direction of movement, the stopper 119 is temporarily moved from the barrier 118 by being carried by the member 68 attached to the rod 112.

Figure 12:
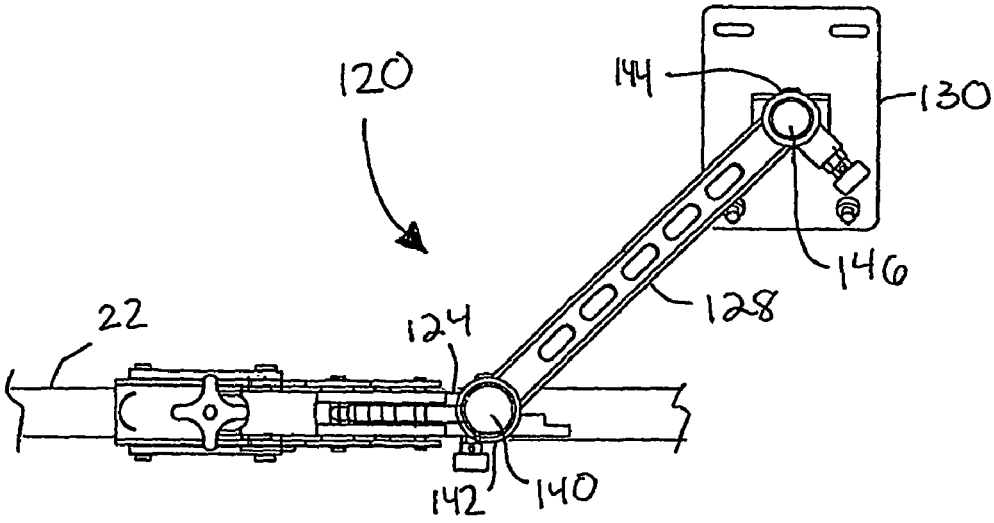
FIG. 12 is a top view showing an upper body member support of the apparatus of FIG. 1.
Figure 13:
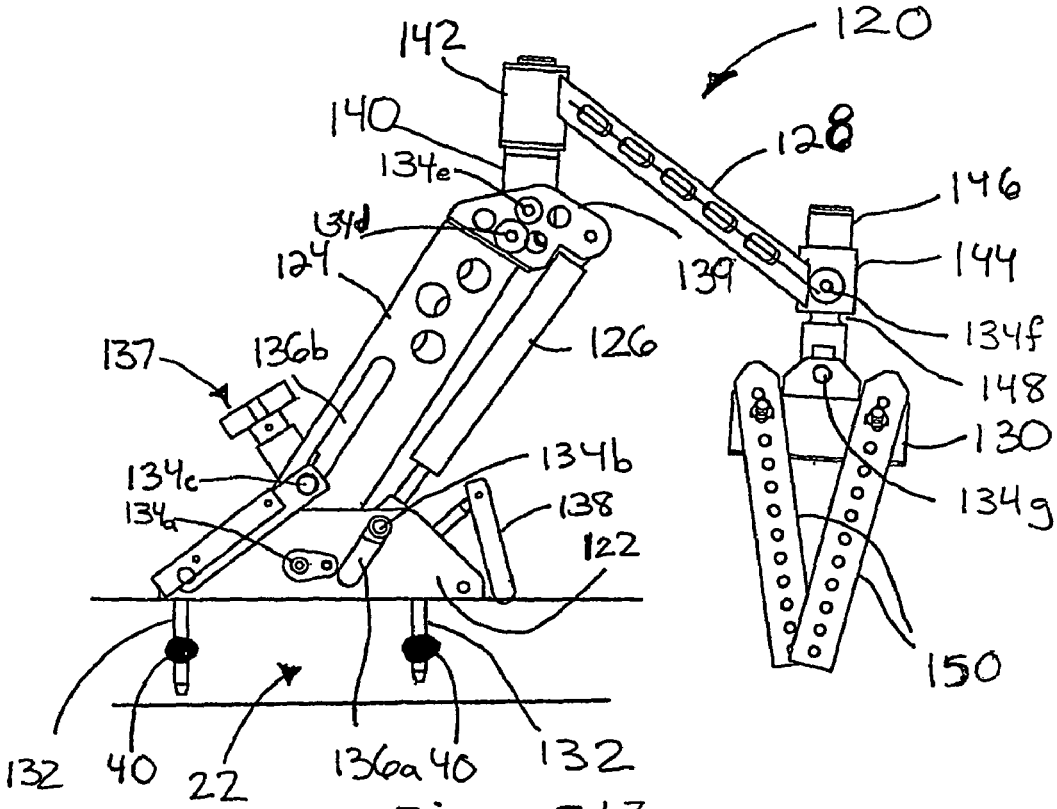
FIG. 13, is a side elevation view showing the upper body member support of FIG. 10.

The exerciser 20 includes an upper body member support assembly 120, as shown in FIGS. 1, 12 and 13. The upper body member support assembly 120 is generally fixedly mounted to the support frame 22 and is adjustable along the length of the support frame 22 depending on the user 38 of the exerciser 20. The upper body member support assembly 120 generally provides assistance in extension or in flexion of the leg of the user 38 when operating the actuating mechanism 32.

The upper body member support assembly 120 generally includes a base 122, a first member 124, a cylinder 126, a second member 128 and a body member support 130. The base 122 is designed to be selectively fixedly positioned along the length of the bars 24, 26. In the embodiment shown in FIGS. 12 and 13, the base 122 is fixedly positioned on top of the bars 24, 26 with fixations 132 going through the bars 24, 26 and may cooperate with the mounting means 40.

At one end, the first member 124 is pivotally mounted to the base 122 through pin 134*a* and the cylinder 126 is pivotally mounted to the base 122 through pin 134*b* engaged in slot 136*a*. The first member 124 and the cylinder 126 therefore pivot along a first axis with respect to the base 122.

The first member 124 further includes a blocking system 137 comprising a pin 134*c* and slot 136*b* arrangement fixedly linking the first member 124 to the base 122. The cylinder 126 also include a force selector 138 which varies the angularity of the cylinder 126 with respect to the base 122 and has the effect of changing the actuating force felt on the body member support 130.

At the other end, the first member 124 has a bracket 139 that supports a central pivot 140 and the other end of the cylinder 126. The central pivot 140 is a generally cylindrical extending body fixedly mounted to the first member 124 through pin 134*d*, 134*e*, allowing the rotation of the second member 128 along a second axis which is generally perpendicular to the first axis. This relative motion is accomplished through one of end 142 of the second member 128 being generally concentrically mounted with respect to the central pivot 140.

The other end 144 of the second member 128 is generally rotatably mounted to a leg pivot 146. The leg pivot 146 generally includes a plurality of circumferential groove 148 so configured as to cooperate with a pin 134*f* attached to the second member 128. The pin 134*f* and groove 148 arrangement allows a pivotal connection between the second member 128 and the leg pivot 146, generally around the second axis of rotation. The provision of the plurality of grooves 148 allows adjustability generally along the second axis, such that the distance between the second member 128 and the body member support 130 is adjustable by selecting the groove 148 with which the pin 134*f* cooperates.

Finally, a pin 134*g* may rotatably link the leg pivot 146 with respect to the body member support 130. The body member support 130 generally has a curved inner surface (not shown) for cooperation with the leg of a user 38, such as for example a thigh. Adjustable bands 150 are also provided from the body member support 130 to attach a user's leg to the inner surface (not shown) of the body member support 130.

Alternatively, the body member support assembly 120 can be placed in a reversed or symmetric position with respect to the bars 24, 26, which corresponds to a 180 degree rotation from the configuration shown in FIGS. 12 and 13, in order to benefit from the reverse cylinder 126 effects. In this case, the central pivot 140 may have to be repositioned with respect to the first member 124. This is made possible, for example, by using a different location on the central pivot 140 for pin 134*e* and by making the central pin 140 pivot about pin 134*d*.

The exerciser 20 of the present invention may further include a belt (not shown) fixedly mounted to the bars 24, 26 to promote optimal stabilization of the exerciser 20 to the pelvic region of the user 38.

Figure 14:
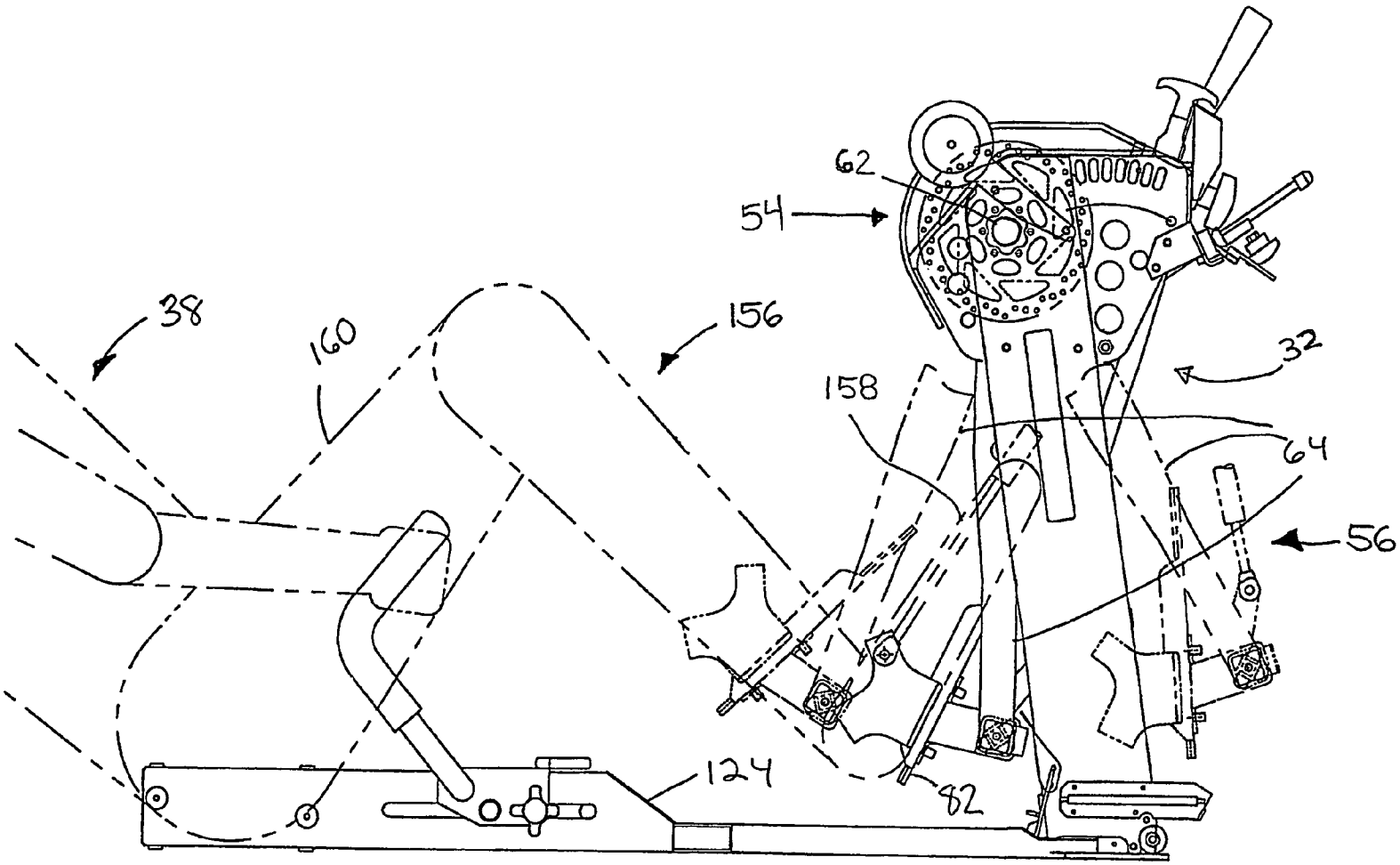
FIG. 14 is a side elevation view showing a user operating the actuation mechanism of FIG. 5.
Figure 15:
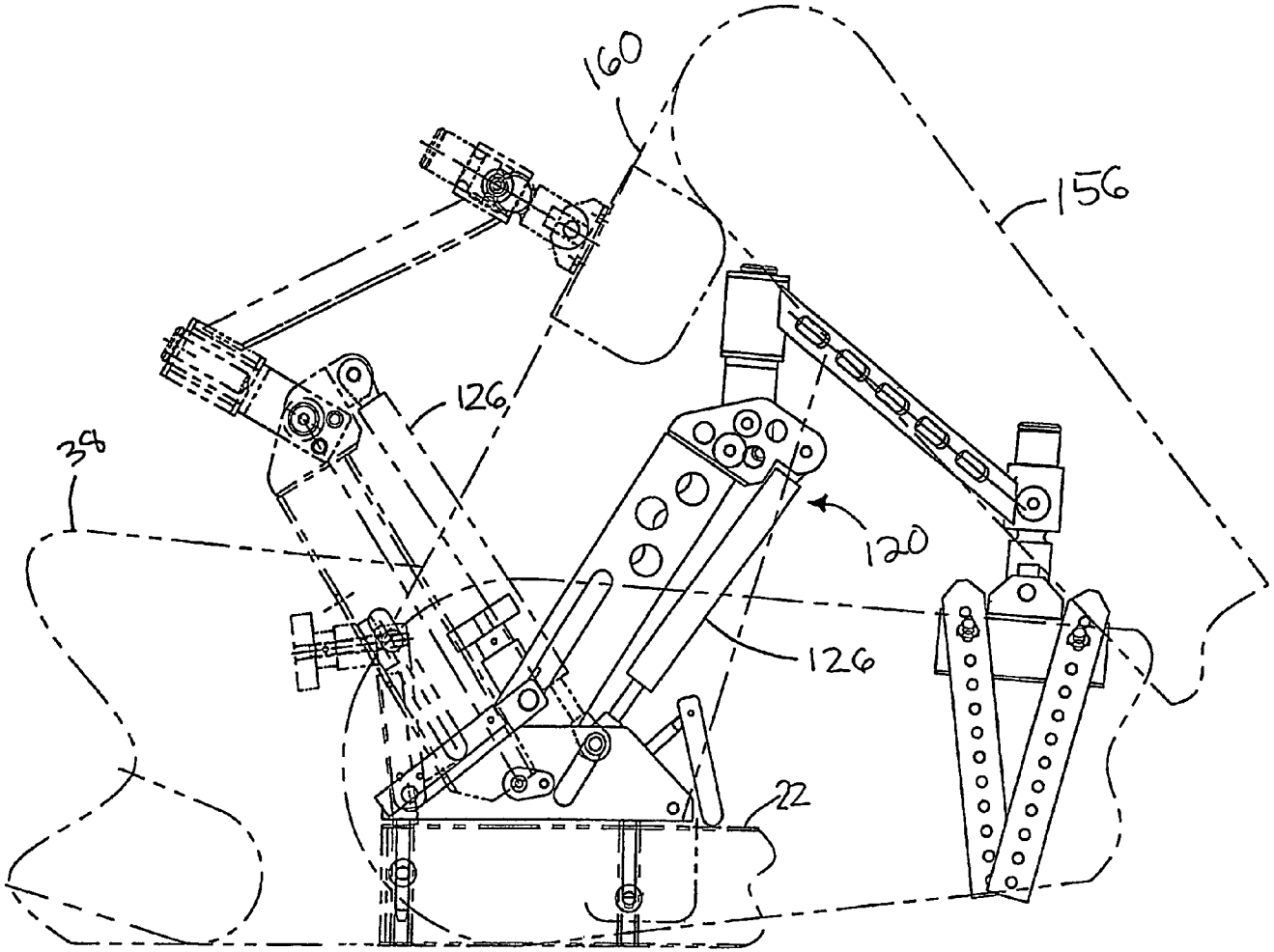
FIG. 15 is a side elevation view showing the user operating the upper body member support of FIG. 10.

The operation of the exerciser 20 and of its actuating mechanism 32 by a user 38 working or providing a force in an extension movement is shown in more details in FIGS. 1, 14 and 15. To use the exerciser 20, the user 38 lies down, is slightly bent near the waist or in a nearly sat position such that his/her legs 154, 156 are generally between the bars 24, 26. One of the legs 156 is positioned near the mechanism 32 such that the foot 158 is positioned on the rest portion 82 of the actuating assembly 64.

As illustrated in FIG. 14, the actuating assembly 64 may adopt a plurality of positions with respect to the fixed portion 54 of the mechanism 32. For an extension movement, the leg 156 is generally bent near 90 degrees when the actuating assembly 64 is closest to the user 38 or in a proximal position.

Upon extension of the leg 156, a force is transferred from the foot 158 of the user 38 to the mechanism 32, such that the actuating assembly 64 is moved in a generally pendulum-like motion about the shaft 62 oscillating in between a proximal position and a distal position, thereby defining an amplitude of movement of the mobile portion 56.

As seen in FIG. 15, the exerciser 20 may also operate with the upper body member support assembly 120. The upper body member assembly 120 also has an amplitude of movement between a proximal position and a distal position and its components are allowed relative rotational movement along the axis of rotations defined by their connections. The upper body member assembly 120 is generally positioned near the waist of the user 38 on the support frame 22.

In response to the actuation of the actuating mechanism 32 and of the upper body member support assembly 120, the exerciser 20 may provide four types of resistance forces, as described hereinabove.

The first one is provided by the cylinder 66, which is a dynamic force applied near the foot 158. This force generally provides resistance to the extension of the leg 156 as the actuating assembly 64 is brought toward its distal position and assistance to the flexion of the leg 156 as the actuating assembly 64 is brought toward its proximal position. The level of resistance is adjusted by the selector 87, as described hereinabove.

The second force is a static force provided by the friction assembly 96 including the disc 98 and calipers 100. This force generally provides resistance to the extension of the leg 156 as the actuating assembly 64 is brought toward its distal position. The level of resistance is adjusted by the cursor 102, as described hereinabove.

The third force is dynamic and is applied to the one-third posterior distal portion of the upper leg 160, provided by the cylinder 126 of the upper body member support assembly 120. This force generally provides resistance to the extension of the hip and assistance to the flexion of the hip and the knee as the actuating assembly 64 is brought toward its proximal position. The level of resistance is adjusted by the pin 134 and slot 136 assembly, as described hereinabove.

Finally, the last force is also dynamic and can be applied to the one-third anterior distal portion of the upper body member 160, provided by the same cylinder 162, but the upper body member support assembly 120 is rotated 180 degrees with respect to the configuration defining the third force, as described hereinabove. This force provides resistance to the flexion of the hip and assistance to the extension of the hip and the leg as the actuating assembly 64 is brought toward its proximal position. The level of resistance may also be adjusted by the pin 134 and slot 136 assembly.

It is easily understood by one skilled in the art that although the exerciser of the present invention has been described herein as being so configured as to work with lower members of a human body, the actuating mechanism could be used on another support frame configuration to exercise other muscle groups, body members or joints, such as for example biceps, triceps, pectorals, elbows, shoulders, ankles.

Although the present invention has been described hereinabove by way of preferred embodiments thereof, it can be modified, without departing from the spirit and nature of the subject invention as defined in the appended claims.

What is claimed is:

1. An orthopedic exerciser for a body member of a user comprising:

a support frame including a generally elongated frame portion and a support portion extending away from said frame portion;

an actuating mechanism comprising a shaft and an actuating assembly;

said shaft being mounted to said support portion and defining a pivot axis;

said actuating assembly including a member having a first end so mounted to and extending away from said shaft as to pivot about said pivot axis and a second end so configured as to receive an actuating force; and a resistance assembly comprising a friction assembly including a disc which is mounted on said shaft and a caliper which is fixedly mounted to said support portion and movable toward said disc, the resistance assembly linking said support portion and said actuating mechanism;

whereby upon operation of said orthopedic exerciser, said actuating assembly pivots along two directions of movement, one of the direction of movement being resisted to by said resistance assembly.

2. An orthopedic exerciser as recited in claim 1, wherein the other direction of movement is assisted by said resistance assembly.

3. An orthopedic exerciser as recited in claim 1, wherein said caliper comprises two calipers positioned on each side of said disc.

4. An orthopedic exerciser as recited in claim 3, wherein said friction assembly further comprises a cursor linked to a spring and connected to said calipers via a lever, said spring varying the tension of said calipers on said disc.

5. An orthopedic exerciser as recited in claim 1, wherein said disc is mounted to said shaft through a one-way clutch system including an inner race fixedly mounted to said shaft, an outer race fixedly mounted to said disc and a clutch system rotatably connecting said outer race to said inner race, said clutch system being so configured as to carry said outer race and said disc in one direction.

6. An orthopedic exerciser as recited in claim 1, wherein said orthopedic exerciser further comprises an upper body member support assembly fixedly mounted to said support frame.

7. An orthopedic exerciser as recited in claim 6, wherein said upper body member support assembly is adjustable along the length of said support frame.

8. An orthopedic exerciser as recited in claim 6, wherein said upper body member support assembly comprises a base fixedly positioned along the length of said support frame, a first member pivotally mounted at a first end to said base along a first axis, a second member rotatably mounted at a first end to a second end of said first member and along a second axis, and a body member support mounted on a second end of said second member generally along said second axis.

9. An orthopedic exerciser as recited in claim 8, wherein said first axis is generally perpendicular to said first axis.

10. An orthopedic exerciser as recited in claim 8, wherein said upper body member support assembly further comprises a cylinder pivotally mounted at a first end to said base along said first axis and a second end pivotally mounted on a bracket near said second end of said first member.

11. An orthopedic exerciser as recited in claim 10, wherein said first end of said cylinder is adjustable with respect to said base through a pin and slot arrangement.

12. An orthopedic exerciser as recited in claim 10, wherein said upper body member support assembly is symmetrically positioned with respect to said support frame.

13. An orthopedic exerciser as recited in claim 8, wherein said upper body member support-assembly comprises adjustable bands.

14. An orthopedic exerciser as recited in claim 1, wherein said support frame comprises two generally laterally adjustable parallel bars and two generally laterally adjustable beams mounted adjacent to each of said bars, said bars being linked in a generally V-shaped configuration in the vicinity of where said beams are mounted to said bars.

15. An orthopedic exerciser as recited in claim 1, wherein said support frame comprises handles.

16. An orthopedic exerciser as recited in claim 15, wherein said handles are adjustable.

17. An orthopedic exerciser as recited in claim 1, wherein said support portion comprises a beam and said frame portion comprises a bar, said beam being mounted to said bar via a clip having one end pivotally mounted on said beam and another end cooperating with a protrusion on said bar.

18. An orthopedic exerciser as recited in claim 1, wherein said support portion comprises a beam and said frame portion comprises a bar, said beam being mounted to said bar via a pin extending from said beam which slidably engages a slot on said bar.

19. An orthopedic exerciser as recited in claim 1, wherein said support portion comprises a beam and said frame portion comprises a bar, said beam being fixedly mounted to a base removably mounted to said bar.

20. An orthopedic exerciser as recited in claim 1, wherein said support portion comprises two beams, said beams extending at a distance from each other, thereby defining an opening where said actuating mechanism is located.

21. An orthopedic exerciser as recited in claim 1, wherein said shaft is pivotally mounted to said support portion and said member is fixedly mounted to said shaft.

22. An orthopedic exerciser as recited in claim 1, wherein said orthopedic exerciser further comprise a belt fixedly mounted to said support frame.

* * * * *